United States Patent [19]

Moore et al.

[11] 4,185,751

[45] Jan. 29, 1980

[54] RADIATOR CAP

[75] Inventors: Phillip L. Moore, Detroit, Mich.; John H. Evans, Connersville, Ind.

[73] Assignee: Stant Manufacturing Company, Inc., Connersville, Ind.

[21] Appl. No.: 929,655

[22] Filed: Jul. 31, 1978

[51] Int. Cl.[2] ..... B65D 51/16

[52] U.S. Cl. ..... 220/203; 220/303; 220/DIG. 32

[58] Field of Search ..... 220/203, 303, 301, 295, 220/DIG. 32, 298; 137/393, 393.3, 393.6

[56] References Cited

U.S. PATENT DOCUMENTS

| | | | |
|---|---|---|---|
| 2,406,502 | 8/1946 | Lines | 220/203 |
| 2,582,209 | 1/1952 | Smith et al. | 220/203 |
| 2,732,971 | 1/1956 | Holmes | 220/203 |
| 3,102,660 | 9/1963 | Bowden | 220/303 X |
| 3,164,288 | 1/1965 | Boomgaard | 220/203 |
| 3,715,049 | 2/1973 | McMullen et al. | 220/203 |
| 3,878,965 | 4/1975 | Crute | 220/303 X |

*Primary Examiner*—Allan N. Shoap
*Attorney, Agent, or Firm*—Jenkins, Coffey, Hyland, Badger & Conard

[57] ABSTRACT

A radiator cap for a vehicle cooling system of a basically closed type includes a first valve which is open when the interior of the radiator is at atmospheric pressure, and remains open until fluid flow out of the radiator closes it. A second, or overpressure, valve in the radiator cap functions to vent the radiator only if potentially damaging excessive pressure exists within the radiator. The normal operating pressure range of the radiator is between the closing pressure of the first valve and the opening pressure of the second valve. When a low vacuum exists within the radiator, the first valve opens, permitting a metered flow of liquid coolant from a coolant recovery bottle back into the cooling system radiator. When a high vacuum is present within the radiator, the first valve opens further to permit higher flow rates of coolant back into the radiator.

12 Claims, 8 Drawing Figures

RADIATOR CAP

This invention relates to liquid-cooled engine cooling systems, and particularly to closure caps for liquid coolant radiators.

There are several types of vehicle engine liquid coolant systems. One type, commonly referred to as a closed system, maintains the radiator in a closed condition until potentially damaging overpressure exists in the radiator, at which time, the radiator is vented to atmosphere. Another type, commonly referred to as an open system, permits coolant to flow from the radiator whenever pressure exists in the radiator. Typically, the coolant drains into a coolant recovery bottle, and flows back into the radiator as coolant remaining in the radiator cools and contracts, e.g., after the vehicle engine is stopped.

Another type of system is a "hybrid" type system in which liquid coolant is permitted to flow freely from the radiator as the coolant heats and expands, until the lower end of a perdetermined operating (superbatmospheric) pressure range within the radiator is reached. At this time, the coolant system becomes a closed system, due to the operation of a valve in the radiator closure cap. The system remains a closed system as pressure within the radiator increases until and unless potentially damaging overpressure is reached in the radiator. Should such an overpressure condition occur, a second valve in the radiator operates to relieve the overpressure, typically venting expanding liquid coolant into a coolant recovery bottle. Another valve mechanism in the radiator closure cap protects the radiator and cooling system against vacuum (subatmospheric pressure) condition within the radiator and cooling system. This additional valve mechanism operates when a predetermined subatmospheric pressure is reached within the radiator, typically due to the contracting and cooling of coolant after the vehicle engine is stopped. Once this predetermined subatmospheric pressure is reached in the radiator, the radiator is vented to atmosphere until this subatmospheric pressure condition is relieved.

Prior art closure caps incorporating valves to handle various pressure-vacuum venting functions are illustrated in many U.S. Pat. Nos., including: 3,216,608; 2,760,376; 2,732,971; 3,111,239; 3,027,043; 2,918,191; 2,195,266; 3,878,965; and 3,164,288.

According to the invention, a radiator cap includes a first valve for controlling fluid flow into and from a radiator between a first fluid flow rate out of the radiator, corresponding to a first subatmospheric pressure within the radiator, and a first fluid flow rate into the radiator, corresponding to a first subatmospheric pressure within the radiator. The radiator cap further includes a second valve for controlling fluid flow from the radiator above a second fluid flow rate out of the radiator corresponding to a second superatmospheric pressure within the radiator.

The first valve controls flow into the radiator between atmospheric pressure and the first subatmospheric pressure through an orifice having a first cross-sectional area. The first valve is responsive to pressures in the radiator lower than the first subatmospheric pressure to open the orifice to greater cross-sectional area to permit higher flow rates into the radiator at pressures lower than the first subatmospheric pressure.

Additionally, the radiator includes a filler neck providing a seat for the second valve. The cap includes a shell and a shank supported from the shell. The shank supports the second valve for movement axially of the neck. The second valve includes a bottom plate, a gasket for the second valve supported between the bottom plate and the second valve seat, and a coil spring surrounding the shank and disposed between the shell and bottom plate to urge the second valve gasket against the second valve seat. The neck includes an axially outer lip and the cap includes a diaphragm and cooperating gasket supported directly beneath the shell in sealing engagement with the lip when the cap is closing the neck. The neck further includes an overflow port positioned axially between the lip and the second valve seat. The shank is inverted cup-shaped and includes an aperture providing communication between the overflow port and the first valve.

The cap further includes a retainer for connecting the bottom plate to the shank. The bottom plate includes a radially outer, axially outwardly extending skirt and the retainer includes a radially outwardly projecting flange.

Additionally, the first valve includes a stem extending generally coaxially of the shank, the shank housing the first valve stem. The first valve further includes a ferrule supported by the bottom plate and movably supporting the first valve stem. The ferrule also includes a venting aperture. The valve stem has a retainer at its axially outer extent within the shank and a first valve head at its axially inner extent. The second valve gasket provides a seat for the first valve head, the valve head being movable axially outwardly toward the second valve gasket to close the first valve and axially inwardly away from the second valve gasket to open the first valve.

The first valve head includes a first portion cooperating with the ferrule to define the orifice of first cross-sectional area, and additional portions cooperating with the ferrule to define orifices of greater cross-sectional area as the first valve stem moves respectively from an axially more outward position to an axially more inward position. At maximum flow into the radiator, the first valve stem cooperates with the ferrule to define the orifice.

A first valve spring is provided between the retainer on the first valve stem and the ferrule. The valve spring is a coil spring and surrounds the first valve stem. The first valve spring has a spring constant which supports the first valve head out of sealing engagement with the second valve gasket under the weight of the stem, retainer and head until a flow rate of coolant from the radiator is reached corresponding to the lower limit of the radiator pressure operating range. The first valve spring also permits the first portion of the first valve head and the ferrule to remain in their relative positions defining the orifice of the first cross-sectional area during initial travel of the first valve stem under vacuum conditions (low-vacuum) in the radiator. When the pressure in the radiator drops below the first subatmospheric pressure, the second portion of the first valve head moves into cooperative position with the ferrule to define the orifice of second cross-sectional area.

The invention may best be understood by referring to the following description and accompanying drawings which illustrate the invention. In the drawings.

Figure 1:
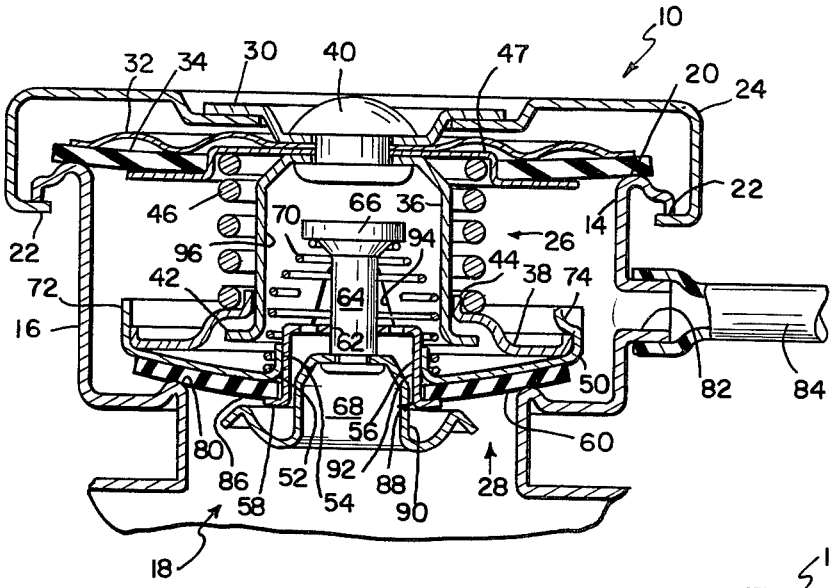
FIG. 1 is a sectional side elevational view of an engine cooling system radiator cap with the radiator pressure between a low-vacuum condition and the lower limit of the operating pressure range.

Referring now to FIG. 1, the cap 10 closes an opening 14 provided by a neck 16 in a radiator 18, illustrated fragmentarily. Neck 16 provides an upper annular sealing lip 20 provided with the conventional camming surfaces and locking lands for engaging a pair of diametrically opposed locking ears 22 provided by the shell 24 of cap 10.

The cap 10 may be thought of as constructed from two sub-assemblies, a cap sub-assembly 26 and a bottom plate sub-assembly 28. The cap sub-assembly 26 includes the shell 24, a center plate 30, a spring-type diaphragm 32, a gasket 34, a hollow, inverted cup-shaped shank 36 and a retainer 38 in a vertical stack. Shell 24, center plate 30, diaphragm 32, gasket 34 and shank 36 are held together by a rivet 40. Shank 36 is provided with a radially outwardly extending flange 42 at its axially inner end to capture the radially inner extent 44 of retainer 38 slidably. A coiled compression spring 46 is captured on shank 36 between a spring retainer 47 adjacent the axially inwardly facing surface of diaphragm 32 and the axially outwardly facing surface of retainer 38 to urge retainer 38 to its axially inner extent on shank 36.

The bottom plate sub-assembly 28 includes a bottom plate 50 having a center opening 52 surrounded by an upstanding, axially outwardly projecting flange 54. A ferrule 56 is press-fitted into the center opening 52 and includes an axially inner flange 58. A flat annular gasket 60 is mounted on the bottom plate 50 and is held against it by the flange 58. Ferrule 56 includes a central opening 62. A pressure-vacuum vent valve stem 64 extends movably through the central opening 62 and is provided with a retainer 66 at its axially outer end and a cupuliform valve head 68 at its axially inner end. A coil spring 70 is captured on the valve stem 64 between retainer 66 and the axially outer surface of ferrule 56.

The cap sub-assembly 26 and bottom plate sub-assembly 28 are joined to form the completed cap assembly 10 by crimping an axially outwardly projecting skirt 72 at the radially outer extent of bottom plate 50 radially inwardly at a plurality of points 74, e.g., three, about the perimeter of skirt 72 radially inwardly beyond the radially outer extent of retainer 38. The bottom plate sub-assembly 28 is thereby rotatably captured on the cap sub-assembly 26.

The neck 16 of radiator 18 includes an axially outwardly facing seat 80 against which gasket 60 normally rests when the cap 10 is in closing engagement with neck opening 14. Neck 14 further includes an overflow port 82 positioned axially between lip 20 and seat 80, and connected by an overflow tube 84 to a coolant recovery bottle (not shown).

When the coolant in radiator 18 is between a first subatmospheric (low vacuum) pressure and a first superatmospheric pressure corresponding to the lower limit of the operating pressure range of coolant within radiator 18, the various components of cap 10 are in their positions illustrated in FIG. 1. The weight of the retainer 66, valve stem 64 and head 68 is sufficient to deflect coil spring 70. In this position, the valve head 68 is away from its seat 86 provided by gasket 60. In a working cap, the spring deflection may be sufficient to produce, for example, a 0.060" (1.5 mm) clearance between head 68 and seat 86 with no flow and the valve in the condition illustrated in FIG. 1. If the radiator 18 contents are under pressure, they flow upwardly between valve head 68 and gasket 60, through an orifice 88 defined between the radially outer side wall 90 of valve head 68 and the radially inner side wall 92 of ferrule 56, through ferrule 56 around its center opening 62, outwardly through an opening 94 provided in the side wall 96 of shank 36, and through port 82 and tube 84 to the coolant recovery bottle.

If a pressure less than atmospheric pressure, but greater than a first predetermined subatmospheric pressure, exists within the radiator 18, the retainer 66 deflects coil spring 70 to hold the valve head 68 away from gasket 34, also as illustrated in FIG. 1. This permits coolant liquid to flow back into the radiator from the coolant recovery bottle through the orifice 88. The rate of flow under this low-vacuum condition is carefully controlled by controlling the cross-sectional area of the orifice 88 between side walls 90, 92.

Figure 2:
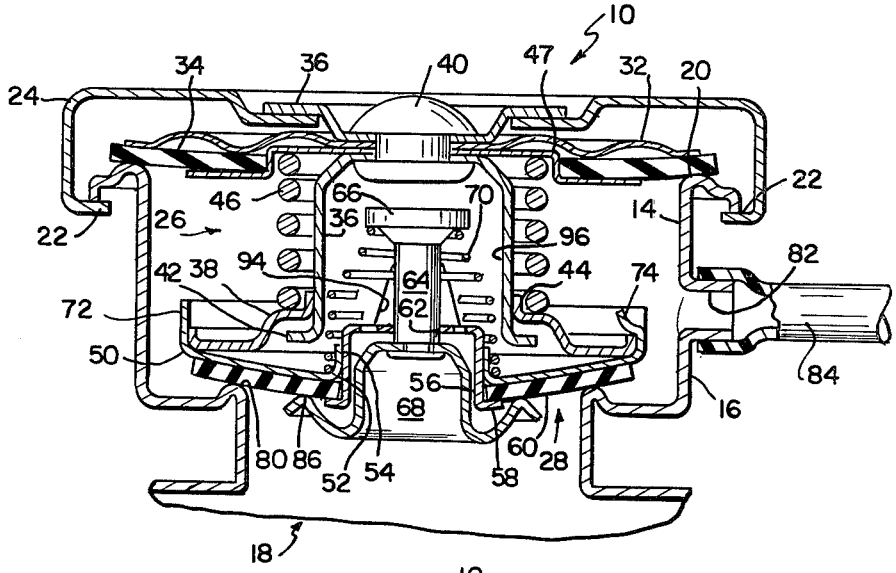
FIG. 2 is a sectional side elevational view of the cap when the engine cooling system radiator is in the steady-state operating condition between the lower and upper limits of its operating pressure range.

FIG. 2 illustrates the steady-state positions of the various valve elements, when the engine cooling system radiator is between the lower and upper limits of its normal operating pressure range. The increased pressure within the radiator, corresponding to a predetermined flow rate of coolant from within the radiator axially outwardly between valve seat 86 and valve head 68 has forced valve head 68 axially outwardly against seat 86, closing the pressure-vacuum vent valve. The pressure within the radiator 18 is not sufficient to raise the gasket 60 and bottom plate 50 off seat 80. Therefore, between the lower and upper operating pressure limits, the radiator 18 is closed.

Figure 3:
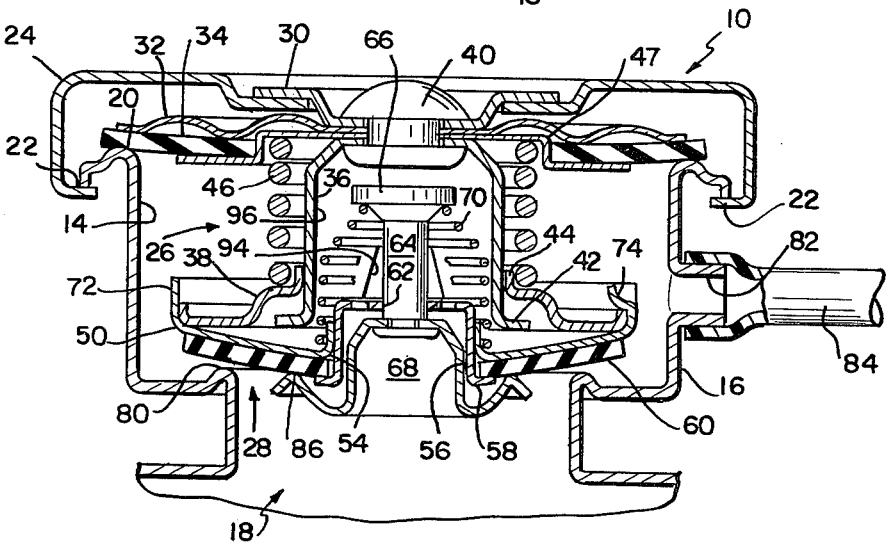
FIG. 3 is a sectional side elevational view of the cap with the radiator at a potentially damaging overpressure value above the operating pressure range.

In FIG. 3, a potentially damaging overpressure condition exists in radiator 18. Gasket 60 has been lifted from its seat 80 in neck 16 against the urging of spring 46 to relieve this overpressure condition. Coolant under high pressure exits between gasket 60 and seat 80 to the overflow port 82, and thence to the coolant recovery bottle. The overflow coolant will later be recovered when a low- or high-vacuum condition develops within the radiator 18.

Figure 4:
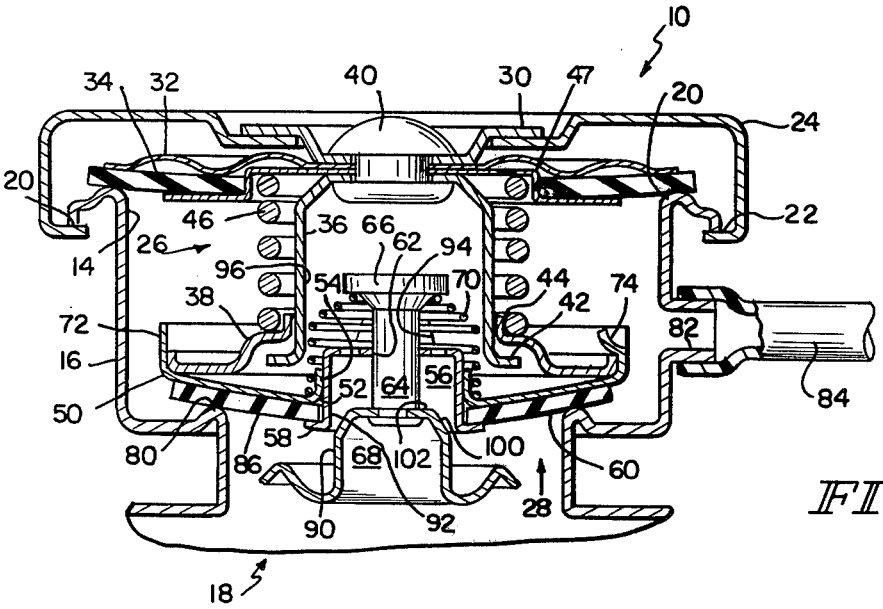
FIG. 4 is a sectional side elevational view of the cap with the radiator in a high-vacuum condition.

The positions of the various cap 10 components under low-vacuum condition have already been discussed. Under high-vacuum conditions, the positions of the valve components are as illustrated in FIG. 4. The pressure differential across the valve head 68 due to the pressure in radiator 18 pulls valve head 68 axially inward. Under such high-vacuum conditions, retainer 66 compresses spring 70 substantially to permit axially inward travel of the valve head 68 such that the generally right circular cylindrical side wall portion 90 of head 68 lies axially inwardly entirely beyond the side wall 92 of ferrule 56. A tapered, or frustoconical, side wall portion 100 of head 68, or the flat axially outer wall 102 of head 68, cooperates with side wall 92 of ferrule 56 under these high vacuum conditions to increase the cross-sectional area of the orifice between these surfaces to an area greater than that of orifice 88 (FIG. 1). This increased orifice area permits much higher flow rates of coolant from the coolant recovery bottle back through overflow tube 84, overflow port 82, opening 94 and between valve head 68 and seat 86 to relieve the high-vacuum condition within radiator 18.

Figure 5:
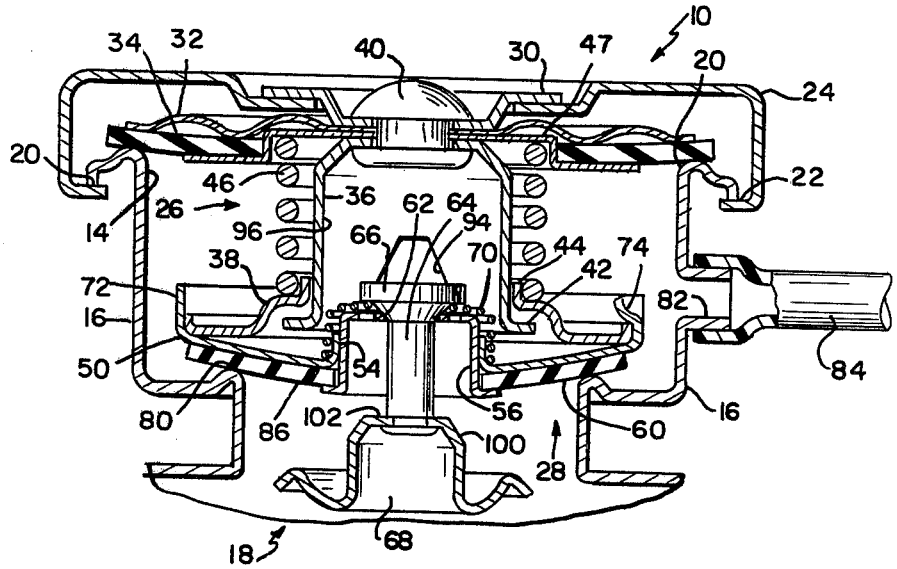
FIG. 5 is a sectional side elevational view of the cap with the radiator in a very high-vacuum condition.

Under very high-vacuum conditions, the positions of the valve components are as illustrated in FIG. 5. The pressure differential across the valve head 68 due to the pressure in radiator 18 pulls valve head 68 axially inward. Under such very high-vacuum conditions, retainer 66 compresses spring 70 substantially to permit axially inward travel of the valve head 68 such that both the generally right circular cylindrical side wall portion 90 of head 68 and the tapered, frustoconical, side wall portion 100 of head 68 lie axially inwardly entirely beyond the side wall 92 of ferrule 56. Under such very high-vacuum conditions, stem 64 cooperates with side wall 92 of ferrule 56 to increase even further the cross-sectional area of the orifice between these surfaces. This increased orifice area permits much higher flow rates of coolant from the coolant recovery bottle back through overflow tube 84, overflow port 82, opening 94 and between valve stem 64 and seat 86 to relieve the very high-vacuum condition within radiator 18.

Figure 6:
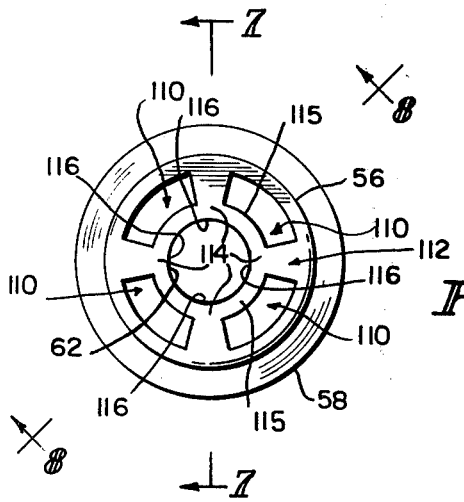
FIG. 6 is an enlarged top plan view of a detail of the radiator cap of FIGS. 1-4.
Figure 7:
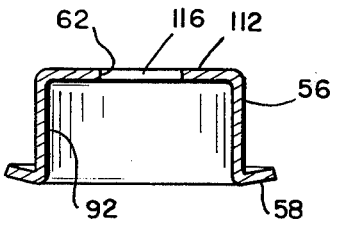
FIG. 7 is a sectional view of the detail of FIG. 6, taken generally along section lines 7—7 of FIG. 6; and, FIG. 8 is a sectional view of the detail of FIG. 6, taken generally along section lines 8—8 of FIG. 6.
Figure 8:
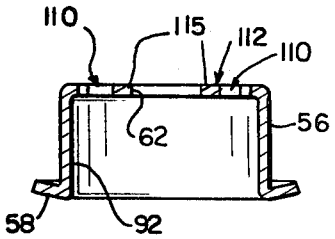

Turning now to FIGS. 6–8, the detailed construction of ferrule 56 is illustrated. FIG. 6 shows that pressure-vacuum venting openings 110 radiate outwardly from the central opening 62 in the ferrule. FIG. 7 shows that the ferrule 56 is generally inverted cup-shaped, and FIG. 8, along with FIG. 6, illustratres that the pressure-vacuum venting openings 110 extend from opening 62 substantially to the side wall 92 of ferrule 56. Substantial venting area is provided through the top 112 of ferrule 56 in the illustrated embodiment by forming openings 110 to cover 60° of arc. Thus, the closed portion of top 112 consists of four equally peripherally spaced, radially extending fingers 114 which extend radially inwardly from side wall 92 and are joined by strengthening ring segments 115 at their radially inner ends 116 to form central opening 62. Each finger 114 spans 30° of arc. The flange 58 at the axially inner end of ferrule 56 inclines axially outwardly in the illustrated embodiment at an angle of about 10°.

This multiple flow-rate vacuum valve configuration, including openings 110 and side wall 92 of ferrule 56, the right circular cylindrical side wall portion 90 of valve head 68, and the generally frustoconically shaped wall portion 100 and flat top portion 102 of valve head 68, permits higher flow rates than prior art vacuum valves of the type illustrated in aforementioned U.S. Pat. No. 3,878,965 under low-vacuum conditions. Under certain circumstances, the illustrated vacuum valve can provide approximately four times the flow rate of such prior art structures under low-vacuum conditions. The attainable flow rate under low-vacuum conditions is a significant consideration in the design of the vacuum valve portion of a radiator cap. Prolonged exposure of the interior of the cooling system even to low-vacuum conditions can result in collapsing of coolant return lines from the vehicle engine block to the radiator.

Further, the vacuum valve configuration of the instant arrangement provides higher flow rates under high-vacuum conditions than vacuum valves of prior art configurations, such as the one illustrated in the aforementioned U.S. Pat. No. 3,878,965. Under certain high-vacuum conditions, the vacuum valve configuration of the instant arrangement can provide flow rates approximately three times the maximum flow rates available with prior art vacuum valves. Again, this higher delivery rate of coolant under high vacuum conditions in the cooling system minimizes the likelihood of coolant system hose collapse, and other failures in cooling system components resulting from prolonged exposure of the cooling system components to vacuum conditions.

What is claimed is:

1. A radiator cap including a first valve for controlling fluid flow into and from a radiator between a first superatmospheric pressure within the radiator and a first subatmospheric pressure within the radiator, and a second valve for controlling fluid flow from the radiator above a second and greater superatmospheric pressure within the radiator, the first valve including pressure responsive means controlling flow into the radiator through an orifice having a first cross-sectional area when the pressure within the radiator is between atmospheric pressure and the first subatmospheric pressure, the first valve pressure responsive means further being responsive to pressures in the radiator lower than the first subatmospheric pressure to open the first valve to a cross-sectional area greater than the first cross-sectional area to permit a higher fluid flow rate into the radiator.

2. The apparatus of claim 1 wherein the first valve includes a stem, a ferrule movably receiving the first valve stem, the ferrule including a venting aperture, the first valve stem including a retainer at its axially outer extent, and the first valve pressure responsive means including a head at the axially inner extent of the stem, the second valve including a gasket providing a seat for the first valve head, the first valve head being movable axially outwardly toward the second valve gasket to close the first valve and axially inwardly away from the second valve gasket to open the first valve.

3. The apparatus of claim 2 wherein the first valve head includes a first portion cooperating with the ferrule to define the first cross-sectional area, and a second portion cooperating with the ferrule to define the greater cross-sectional area as the first valve stem moves respectively from an axially more outward position to an axially more inward position.

4. The apparatus of claim 3 wherein the first valve pressure responsive means includes a spring provided between the retainer on the first valve stem and the ferrule.

5. The apparatus of claim 4 wherein the first valve spring is a coil spring surrounding the first valve stem and having a spring constant to support the first valve head out of sealing engagement with the second valve gasket until the first superatmospheric fluid pressure is reached in the radiator, the first valve spring also supporting the first portion of the first valve head and the ferrule in relative positions defining the orifice of first cross-sectional area, and the retainer of the first valve stem moving the second portion of the first valve head into cooperative position with the ferrule to define the greater cross-sectional area when the pressure in the radiator drops below the first subatmospheric pressure.

6. The apparatus of claim 5 wherein the orifice of first cross-sectional area is defined by a generally right circular cylindrical side wall portion of the ferrule and a generally right circular cylindrical portion of the first valve head, and the greater cross-sectional area is defined, at least partly, between the generally right circular cylindrical side wall portion of the ferrule and an axially tapered or frustoconical surface of the first valve head.

7. A radiator cap including a first valve for controlling fluid flow into and from a radiator between a first subatmospheric pressure within the radiator and a first superatmospheric pressure within the radiator, and a second valve for controlling fluid flow from the radiator above a second and greater superatmospheric pressure within the radiator, the first valve including pressure responsive means controlling flow into the radiator through an orifice having a first cross-sectional area when the pressure within the radiator is between atmospheric pressure and the first subatmospheric pressure, the first valve pressure responsive means further being responsive to pressures in the radiator lower than the first subatmospheric pressure to open the first valve to a cross-sectional area greater than the first cross-sectional area to permit a higher fluid flow rate into the radiator, the first valve including a stem, a ferrule movably receiving the first valve stem, the ferrule including a venting aperture, the first valve stem including a retainer at its axially outer extent, and the first valve pressure responsive means including a head at the axially inner extent of the stem, the second valve including a gasket providing a seat for the first valve head, the first valve head being movable axially outwardly toward the second valve gasket to close the first valve and axially inwardly away from the second valve gasket to open the first valve, the ferrule being generally right circular cylindrical in shape and including an axially inner end and an axially outer end, the axially inner end including a radially outwardly projecting flange for locating the ferrule in the cap and the axially outer end including a wall defining a generally central opening for receiving the first valve stem and a plurality of such venting apertures.

8. The apparatus of claim 7 wherein each such venting aperture is defined by a pair of peripherally spaced radially inwardly projecting segments and a ring segment joining the radially inner ends of the radially inwardly projecting segments.

9. A radiator cap including a first valve for controlling fluid flow into and from a radiator between a first superatmospheric pressure within the radiator and a first subatmospheric pressure within the radiator, and a second valve for controlling fluid flow from the radiator above a second and greater superatmospheric pressure within the radiator, the first valve including pressure responsive means controlling flow into the radiator through an orifice having a first cross-sectional area when the pressure within the radiator is between atmospheric pressure and the first subatmospheric pressure, the first valve pressure responsive means further being responsive to pressures in the radiator lower than the first subatmospheric pressure to open the first valve to a cross-sectional area greater than the first cross-sectional area to permit a higher fluid flow rate into the radiator, the first valve including a coil spring, a valve seat, a valve head, and a stem, the spring surrounding the first valve stem and having a spring constant sufficient to support the first valve head out of sealing engagement with the valve seat until a flow rate of fluid from the radiator is reached corresponding to the first superatmospheric fluid pressure in the radiator, the first valve further including means for defining a guide within which the first valve stem is movably mounted and for defining a plurality of venting apertures, the first valve spring permitting the first valve head and the venting aperture-defining means to remain in relative positions defining the orifice of first cross-sectional area, and the first valve stem working against the first valve spring when the pressure in the radiator drops below the first subatmospheric pressure to move the first valve head into cooperative position with the venting aperture-defining means to define the orifice of greater cross-sectional area.

10. A radiator cap comprising a pressure valve member and, centrally within said member, a ferrule providing a pressure-vacuum vent valve passageway, a valve seat, a valve member movable relative to said valve seat to control said passageway, and a spring for yieldably positioning said valve member axially in said passageway, said spring supporting said valve member away from said valve seat when the radiator is at atmospheric pressure to provide a first predetermined flow restriction in said passageway, increased pressure differential across said valve member when the radiator is at higher pressure increasing the flow restriction in said passageway by movement of said valve member, and increased pressure differential across said valve member when the radiator is at lower pressure reducing the flow restriction in said passageway by movement of said valve member.

11. The radiator cap of claim 10 and further comprising an overpressure valve and overpressure venting passageway for venting the radiator when the pressure within the radiator exceeds a safe level.

12. A radiator cap comprising a pressure valve member and, centrally within said member, a ferrule providing a pressure-vacuum vent valve passageway, a valve seat, a valve member movable ralative to said valve seat to control said passageway, and a spring for yieldably positioning said valve member axially in said passageway, said spring supporting said valve member away from said valve seat to provide a first predetermined flow restriction in said passageway, increased pressure differential across said valve member when the radiator is at higher pressure increasing the flow restriction in said passageway by movement of said valve member, and increased pressure differential across said valve member when the radiator is at lower pressure reducing the flow restriction in said passageway by movement of said valve member, the ferrule comprising a generally right circular cylindrical, axially extending portion and an axially outer wall including a guide passage movable receiving the valve member and a plurality of such passageways, the axially outer wall including a plurality of peripherally spaced, radially extending fingers, and a segment of a ring connecting each adjacent pair of fingers to provide each passageway, and the plurality of ring segments cooperating to provide the guide passage.

* * * * *

UNITED STATES PATENT AND TRADEMARK OFFICE

CERTIFICATE OF CORRECTION

PATENT NO. : 4,185,751

DATED : January 29, 1980

INVENTOR(S) : Phillip L. Moore and John H. Evans

It is certified that error appears in the above-identified patent and that said Letters Patent are hereby corrected as shown below:

In the assignment data on the first page, add --Chrysler Corporation, Highland Park, Michigan--.

Column 1, lines 22 and 23, change "(superbatmospheric) to --(superatmospheric)--; line 46, change "2,760,376" to --2,760,367--; line 51, change "subatmospheric" to --superatmospheric--.

Column 8, line 56, (claim 12), change "movable" to --movably--.

Signed and Sealed this

*Fifteenth* Day of *July 1980*

[SEAL]

*Attest:*

SIDNEY A. DIAMOND

*Attesting Officer*

*Commissioner of Patents and Trademarks*